United States Patent [19]

Morini

[11] Patent Number: 4,803,911

[45] Date of Patent: Feb. 14, 1989

[54] SEMI-AUTOMATIC TARGET PISTOL

[75] Inventor: Cesare Morini, Vezia, Switzerland

[73] Assignee: Morini Competition Arm S.A., Switzerland

[21] Appl. No.: 83,641

[22] Filed: Aug. 7, 1987

[30] Foreign Application Priority Data

Dec. 8, 1986 [EP] European Pat. Off. ..... 86830229.0

[51] Int. Cl.[4] ..... F41D 7/08

[52] U.S. Cl. ..... 89/194

[58] Field of Search ..... 89/194, 195, 196, 197, 89/4.5, 183

[56] References Cited

U.S. PATENT DOCUMENTS

| | | | |
|---|---|---|---|
| 684,055 | 10/1901 | Gabbett-Fairfax | 89/195 |
| 809,640 | 1/1906 | Stow | 89/194 |
| 1,202,017 | 10/1916 | Barnes | 89/194 |

FOREIGN PATENT DOCUMENTS

| | | | |
|---|---|---|---|
| 477596 | of 1938 | United Kingdom | 89/194 |

*Primary Examiner*—Deborah L. Kyle
*Assistant Examiner*—Stephen Johnson
*Attorney, Agent, or Firm*—Darby & Darby

[57] ABSTRACT

The invention relates to an improved semi-automatic target pistol. The improvements featured are: a tubular magazine that accommodates cartridges nose-to-tail fashion, and from which the cartridges are extracted singly and transferred to the bore by a pivoted cradle; a hammerless percussion system in which travel of the striker, housed internally of the breechblock, remains independent of breechblock travel; a set of percussion release levers set in motion by squeezing the trigger and energizing a solenoid, and a notably efficient lever mechanism for ejection of the spent cartridge.

5 Claims, 3 Drawing Sheets

SEMI-AUTOMATIC TARGET PISTOL

BACKGROUND OF THE INVENTION

The invention disclosed relates to an improved semi-automatic target pistol.

More exactly, the pistol in question is of the type utilized in "semi-automatic", "standard", and "large caliber" classes of competition, although the design can be extended to cover other types of long- and short-barrelled semi-automatic firearms.

The requirement in these classes of competition is for a pistol which can be loaded manually for the initial shot (hence the term "semi-automatic"), then fire off the remainder of shots singly and in rapid succession, in number according to the rules of the competition. Besides being capable of rapid fire, such pistols must incorporate systems whereby cartridges are extracted from the magazine and loaded into the bore without jamming, and without suffering distortion. Also, any vibration attributable to the shift of moving parts deriving from pressure on the trigger must be avoided as far as is feasible, the time lapse between squeezing the trigger and explosion of the cartridge must be kept to a minimum, and recoil transmitted to the marksman's hand must be attenuated as far as possible.

A conventional pistol of the type in question will generally be provided with a magazine in which the cartridges are stacked one on top of the other, and which is inserted into the pistol from the bottom, either into the grip or into the body of the firearm itself; thus, in passing from the magazine to the bore, the cartridge is taken through a somewhat tortuous path that can occasion its distortion, and in certain rare instances, cause the firearm to jam. Moreover, percussion in handguns of the general type referred to is produced by a hammer-and-striker assembly that constitutes a source of minor vibrations on the one hand, deriving from rotation of the hammer, and on the other, absorbs the recoil from the explosion only in part when the firearm is reloaded, instead of progressively and fully.

Despite such drawbacks, percussion systems of the hammer-and-striker type continue to be adopted, due to the fact that conventional hammerless systems are characterized by relatively long striker travel, a feature which renders them unsuitable for target pistols of the type in question.

Accordingly, it is an object of the invention to overcome the drawbacks described above by providing a pistol in which the path followed by a single cartridge during loading is rendered less tortuous, in which any vibration attributable to rotation of a hammer is avoided, and in which the recoil following explosion of the cartridge is absorbed gradually and to a much greater degree than in pistols of prior art design.

One advantage provided by a pistol according to the invention is that the travel of the firing pin can be kept particularly short, such that the time lapse which separates squeezing of the trigger from firing of the cartridge is markedly reduced.

A further advantage afforded by the pistol disclosed is that of a highly efficient system for the ejection of spent cartridge shells.

SUMMARY OF THE INVENTION

The stated objects and advantages, and others besides, are achieved with a pistol as described and claimed herein.

An improved target pistol according to the invention comprises a tubular magazine from which cartridges, accommodated nose-to-tail and disposed coaxially one with the next, are extracted singly and held by a pivoted cradle inside the pistol before being transferred to the bore by a simple upward movement of the cradle.

A hammerless percussion system is adopted, in which movement of the striker is generated parallel to the axis of the barrel and in which the distance covered by the firing pin can be kept particularly short by reason of the fact that travel of the pin remains independent of travel of the breechblock.

In addition, the cocking system of the improved pistol permits of absorbing recoil both gradually and to a considerable degree, and the system adopted for ejection of the shells of spent cartridges features a lever that is afforded a singularly generous arc of movement in order to ensure faultless ejection of the shell.

BRIEF DESCRIPTION OF THE DRAWINGS

The invention will now be described in detail, by way of example, with the aid of the accompanying drawings, in which.

DESCRIPTION OF THE PREFERRED EMBODIMENT

The improved target pistol comprises a body 2 housing the mechanical parts of the firearm; 4 denotes the barrel of the pistol, which is connected to the body, 6 denotes a trigger located directly beneath the body, and 7 denotes a grip to which the body 2 itself is attached. The body 2 is substantially box-like in embodiment, with two open sides, and affords a housing internally of which a breechblock 1 is slidably accommodated.

Figure 1:
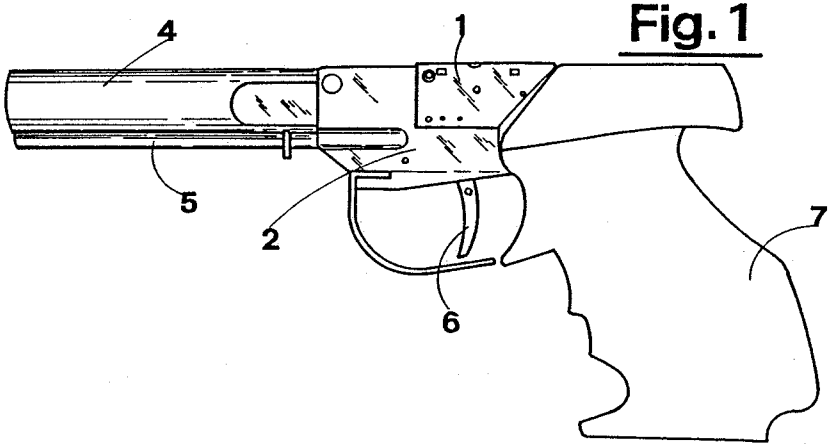
FIG. 1 is a side elevation of the pistol.
Figure 4:
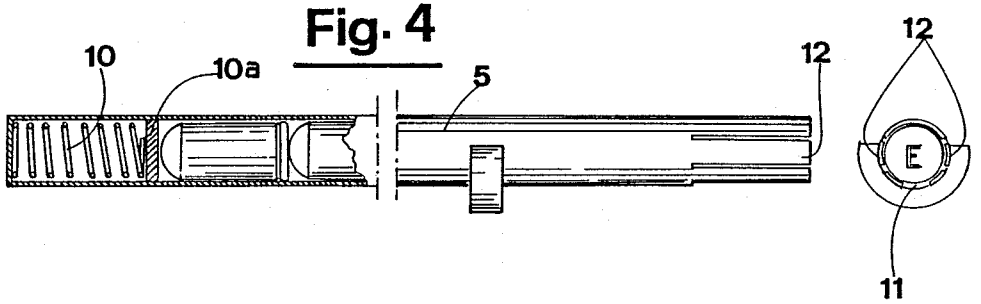
FIG. 4 is a detailed illustration of the magazine of a pistol according to the invention.

Prior to firing of a shot, the breechblock 1 occupies a closed position in which it occludes the rear end of the bore (see FIG. 1), thereafter sliding back into the open position under the pressure of the gases produced by explosion of the cartridge; movement of the breechblock 1 during this backwards slide is opposed by coil springs 3 located at the rear of the block itself, which are loaded on suitable pilot rods.

5 denotes a magazine of tubular shape which is designed to accommodate cartridges 8 in nose-to-tail fashion, disposed coaxially one with the next; the magazine is provided internally with tension means, consisting in a spring 10 and a plunger 10*a*, that urge the cartridges constantly toward its open rear end. The open end of the magazine in question incorporates a longitudinal slot 11, the purpose of which is described below, and two longitudinal retainers 12 the embodiment of which is obtained by making appropriate cuts in the outer surface of the magazine; these retainers are capable of flexing radially, and are designed to prevent the cartridges from being projected out of the magazine under the pressure of the spring 10. The magazine fits into the body of the pistol, occupying a position parallel to and immediately beneath the barrel with its slot 11 facing downwards, for reasons which will become apparent.

The system whereby cartridges are extracted from the magazine and transferred to the bore comprises a cradle 13, pivotably mounted to the body 2 of the pistol at a point below the breechblock 1 and provided with a housing of shape such as will accommodate a single cartridge.

The cradle 13 can be rotated about the axis of its pivot between a first position, in which the housing is disposed coaxial with the magazine in such a way as to receive the extracted cartridge, and a second position in which the front end of the housing is located in close proximity to the rear end of the bore, the housing being incorporated into the end of the cradle opposite to its pivoted end. The cradle is held in the first position by a third lever 17 pivotably mounted to the body of the pistol at a point below the breechblock and provided with a relief **17*a* that engages the rear end of the cradle, thus preventing its rotation. The third lever 17 is biased by a flat spring 17*b* toward a catch position, in which the cradle is held in the first position, and is rotated clockwise as viewed in FIG. 3) into a release position by the breechblock when moving toward its open position, thereby freeing the cradle; it will be observed that the breechblock directly engages the topmost extremity of the lever 17**.

Release of the cradle 13 immediately following initial opening movement of the breechblock being undesirable, a groove 21 is provided in the bottom of the breechblock which allows its passage over the lever 17 without making contact; in effect, the length of the groove will be such that the lever 17 is engaged only when the breechblock arrives within a short distance of the open position. Thus, with the breechblock moving back and the cradle about to rise, one avoids contact between the block and the cartridge occupying the cradle.

14 denotes a first lever pivotably mounted to the body of the pistol at a point below the cradle, which engages the cradle directly and is provided with tension means in the form of a spring **14*a***, that produce its rotation in such a way as to urge the cradle up into second position; clearly, such movement is enabled only when the cradle is released.

15 denotes a second lever which is pivotably mounted to the end of the first lever 14 opposite that in contact with the cradle, provided at one end with a catch **15*a* positioned to coincide with the end of the slot 11 in the magazine, and biased upwards by a spring 15*b*; the remaining end of the second lever 15 terminates in a shank 15*c*** that enters into contact with the body of the pistol when the cradle is in first position, thereby inhibiting rotation of the lever itself and disallowing escape of the remaining cartridges from within the magazine.

Figure 3:
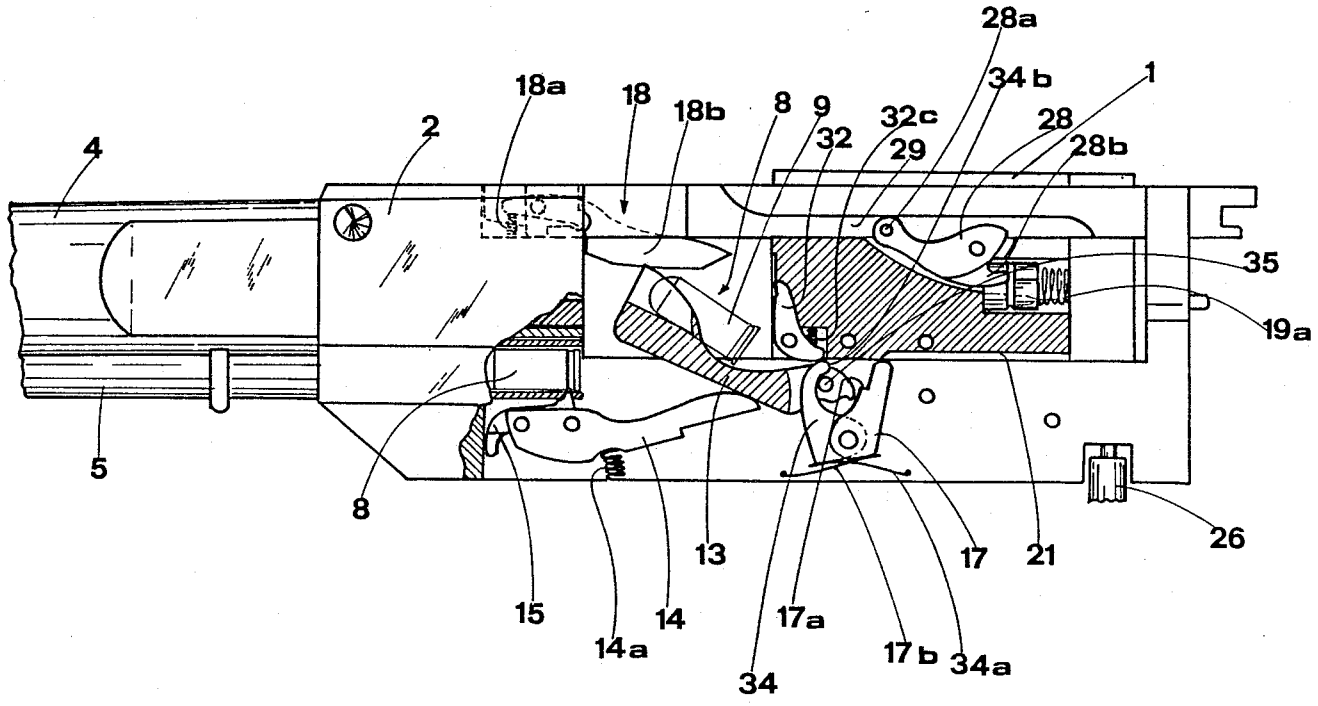
FIG. 3 is a side elevation of the mechanism of the pistol seen in enlarged scale with certain parts cut away or omitted better to reveal others, and showing the breechblock in open position.

FIG. 3 shows the configuration of the breech immediately prior to arrival of the breechblock 1 in fully open position, and with the cradle 13 released and fully raised. It will be observed that the cartridge 8 is brought into an angled position by the rotational movement of the cradle; accordingly, the pistol comprises a movable guide 18 mounted pivotably to the body at a point above the breechblock, which serves to bring the cartridge into coaxial alignment with the bore. The guide 18 is forced into a raised position by a groove 16 in the breechblock, when the breechblock is in closed position, and biased into a lowered position by a relative spring **18*a* whenever the breechblock is moved into open position (as in FIG. 3). The shape of the guide is such, that when in lowered position, its rear end 18*b* will be located adjacent to the rear end of the bore, lying above and parallel to the bore axis; thus, as the breechblock gains its backward travel limit, the cartridge raised by the cradle will be urged against the end 18*b* of the lever 18** and obliged to assume a position in which it lies coaxial with the barrel of the pistol, and is therefore transferred with ease into the bore.

The improved pistol comprises a percussion assembly that features a substantially cylindrical striker 19 housed to an exact fit in a chamber located internally of the breechblock and aligned axially with the bore. The striker slides axially within the chamber between an inner position (that of FIG. 2), in which the firing pin lies within the chamber, and an outer position in which the firing pin emerges from the breechblock into a socket 20, located in the front face of the breechblock itself, that accommodates the base of the cartridge. Tension means provided at the rear of the striker comprise a spring **19*b* which biases the striker toward the outer position; the spring 19*b*** itself will be appreciably rigid, so that the striker can be subjected to a substantial degree of force and propelled at high speed, as well as being enabled to absorb the better part of the recoil, as will shortly become clear.

24 denotes a detent lever pivotably mounted to the breechblock, one end of which is provided with a catch **24*a*; the remaining end engages a spring 24*b* that biases the lever into a detent position whereby the catch 24*a*** locates against an abutment surface offered by the striker, and thus detains the striker in the inner position.

25 denotes a set of levers, of which there are four in the embodiment illustrated. The first lever of the set is pivotably mounted to the body of the pistol; the last lever and the detent lever 24 are one and the same. The four levers engage one with the next in direct contact, and are embodied and arranged such that a rotation of the first produces corresponding rotation of the last, and vice versa. The rear end of the first lever of the set 25 is engaged by the core **26*a* of a solenoid 26 that will be energized by way of a conventional electrical circuit to which the trigger 6 is wired; squeezing the trigger, the core 26*a* shifts and induces counterclockwise rotation of the first lever of the set, whereupon a chain reaction is set up (discernable easily from FIG. 2) the result of which is that the detent lever 24** will free the striker.

Transmission of the movement of the trigger to the set of levers 25 could be accomplished equally well adopting an all-mechanical linkage as generally fitted in production pistols, though the electrical system offers greater speed and dependability.

The fact that the detent lever 24 is mounted to the breechblock signifies that these two parts move as one; as a result, travel of the striker, which must be kept as short as possible, is rendered independent of the distance travelled by the breechblock, which is necessarily much greater. At all events, inclusion of the set of levers 25 enables the solenoid core to act directly on a lever pivoted to the body of the pistol, hence located in a fixed position, and the arrangement of the levers is such as to ensure instantaneous transmission of the movement of the core (i.e. of the trigger) to the striker release mechanism.

The cocking system of the improved pistol features a contoured lever 28 pivotably mounted to the breechblock, a first end 28*a* of which engages in a groove 29 during the sliding movement of the breechblock; the groove in question is incorporated into the body, above the breechblock, and shaped such as to produce rotation of the cocking lever one way or the other according to the direction in which the breechblock is moving. The remaining end of the cocking lever, denoted 28*b*, is designed to engage a radial projection 19*a* offered by the striker; this comes about whenever the lever 28 itself is made to rotate in the appropriate direction by movement of the breechblock toward the open position, the result being that the striker is forced into the inner position and its abutment surface brought behind the catch of the detent lever 24.

The profile of the groove 29 is embodied such as to rotate the cocking lever 28 gradually during movement of the breechblock, thereby dictating the degree of pressure exerted on the striker spring 19*b;* thus, by selection of the appropriate profile, it becomes possible to apportion the effects of the recoil in relation to travel of the breechblock.

On firing the shot, gases generated by the explosion cause the breechblock to slide backwards, drawing with it the shell of the spent cartridge, which will be locked in the socket 20 by a retention lever 31 of conventional type.

The empty shell is removed from the breech by an ejector lever 32 pivotably mounted to the breechblock 1, a first arm 32*a* of which is biased by tension means consisting of a spring 32*c* into an at-rest position that holds it flush with the base of the socket 20; the second arm 32*b* of the ejector lever projects from the underside of the breechblock.

34 denotes a fourth lever, pivotably mounted to the body of the pistol, which is biased by a spring 34*a* into contact with a stop 35 lying coincident with the axis about which the cradle 13 is pivoted; the stop 35 inhibits clockwise rotation of the lever 34 (as viewed in FIG. 3) on arrival at a given limit position in which the top end 34*b* of the lever is directed upwards and engages the second arm 32*b* of the ejector lever 32 during travel of the breechblock. With the block moving backwards, the ejector lever 32 is brought up against the fourth lever 34 and obliged thus to rotate counterclockwise in such a way that its first arm 32*a* is projected from the socket 20 perpendicularly, thereby ejecting the shell. A generous degree of movement can be afforded to the first arm of the ejector lever 32 by appropriate calculation of the size ratio between the arms 32*a* and 32*b*.

It will be observed that the ejector lever 32 must engage in contact with the fourth lever 34 when the breechblock is moved in the opposite direction also, though in this instance the fourth lever 34 is able to rotate counterclockwise and thus causes no impediment as a result of such contact; the lever 34 is returned subsequently to the eject limit position by its spring 34*a*.

Operation of the improved target pistol will now be described.

Cartridges are loaded into the magazine one by one and pushed gently home, prevented from springing out of the magazine by the retainers 12, whereupon the full magazine is fitted to the pistol in the manner aforedescribed.

A first shot is loaded into the bore by manual operation of the breechblock, which produces the same set of movements as will occur in subsequent automatic loading, shortly to be described. The pistol will thus be in the configuration of FIG. 2, with a first cartridge inserted into the bore (not visible), a second occupying the cradle, and the remainder still inside the magazine. The breechblock is in closed position, the striker drawn back, the cradle in its first position, the third lever 17 (not illustrated in FIG. 2) in the catch position, the guide 18 in its raised position, the detent lever 24 in the detent position, and the catch 15*a* of the second lever 15 located against the leading cartridge held currently in the magazine.

Squeezing the trigger, the core of the solenoid is caused to shift, thereby engaging the first of the set of levers 25 and occasioning clockwise rotation of the detent lever 24. The striker 19 is thus freed and can be propelled forward, such that the firing pin projects from the breechblock and strikes the cartridge primer.

Following explosion of the primer, gases are given off the pressure of which forces the breechblock back toward the open position. As soon as this movement is under way, the first end of the cocking lever 28 engages in its groove 29 and rotates counterclockwise, such that the remaining end can engage the radial projection 19*a* of the striker and drive the striker itself back to the inner position, a process which takes place as the breechblock moves backwards; continued application of force from the respective springs 19*b* and 3 thus ensures a progressive and lasting attenuation of the recoil. It will be remembered that the embodiment of the profile of the groove 29 is a determining factor in gauging attenuation of the recoil during backward movement of the breechblock.

Next, the ejector lever 32 is brought into contact with the fourth lever 34, thereby separating the empty cartridge shell from the socket 20 in the breechblock and causing it to eject. With the breech block almost in open position, the guide 18 will be freed, and urged down into lowered position by its spring 18*a;* at the same time, the breechblock enters into contact with the third lever 17, which rotates clockwise and releases the cradle. The first lever 14, now urged upwards by its spring 14*a*, pushes the cradle upward into the second position, whereupon the cartridge currently accommodated is sandwiched between cradle and guide 18 and brought into coaxial alignment with the bore.

Rotation of the first lever 14 will have the effect of separating the shank 15*c* of the second lever 15 from the body of the pistol, and the second lever rotates counterclockwise such the catch 15*a* can clear the lip offered by the base of the endmost cartridge in the magazine: the movement in question is both enabled by provision of the slot 11 in the magazine, and favored by the relative spring 15*a*. Once at the fully open position, the breechblock 1 will invert and commence return travel toward the closed position.

The cocking lever 28 will have forced the striker 19 back against its spring during backward movement of the breechblock; now, on the return stroke, engagement in the groove 29 will cause the lever to reassume its former position. The third lever 17 returns to the catch position, its relief 17*a* locating in the relative groove 21 offered by the breechblock. It will be remembered that contact between the ejector lever and the fourth lever can occasion no mishap during return of the breechblock, given that the fourth lever 34 is able to rotate counterclockwise.

The cartridge currently occupying the cradle is now thrust into the bore by the breechblock, whereupon the alignment guide 18 will locate in the relative groove 16 of the breechblock; thus, with the breechblock advancing toward closed position, the guide 18 is returned upwards to its raised position, and the cradle 13 urged downward to its lowered position: lowering of the cradle has the effect of rotating the first and second levers 14 and 15 in the clockwise direction. With the breechblock fully returned to the closed position, the catch 15*a* of the second lever 15 locates against the lip of the endmost cartridge of the magazine and occasions its extraction: free to move, the cartridge is urged onto the cradle by the force of the spring 10 and plunger 10*a*.

The cartridge next behind in the magazine is urged similarly toward the cradle, but will be prevented from leaving the magazine by virtue of the fact that the catch 15*a* returns to its retaining position immediately following the release of the former cartridge; in effect, clockwise rotation of the first lever 14 having once again urged the shank 15*c* of the second lever 15 into contact with the body of the pistol, further clockwise rotation of the second lever 15 is inhibited.

Figure 2:
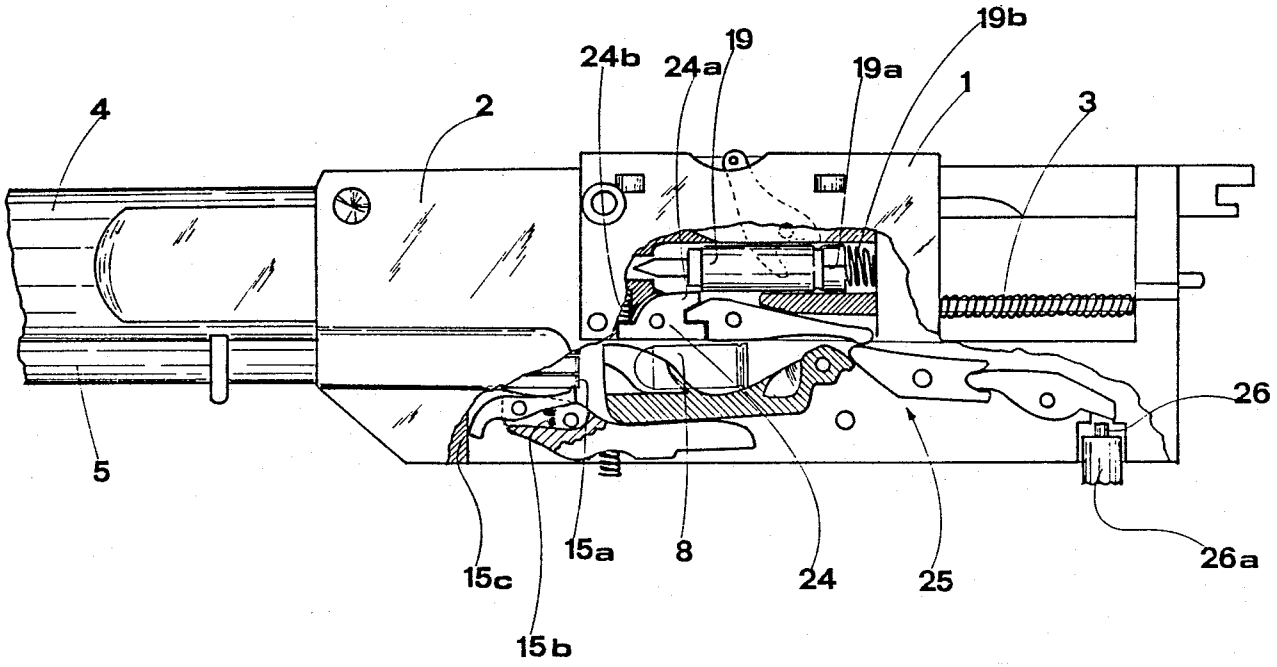
FIG. 2 is a side elevation of the mechanism of the pistol seen in enlarged scale with certain parts cut away or omitted better to reveal others, and showing the breechblock in closed position.

At this point, the configuration of the pistol is as indicated in FIG. 2, ready for the next shot.

Figure 6:
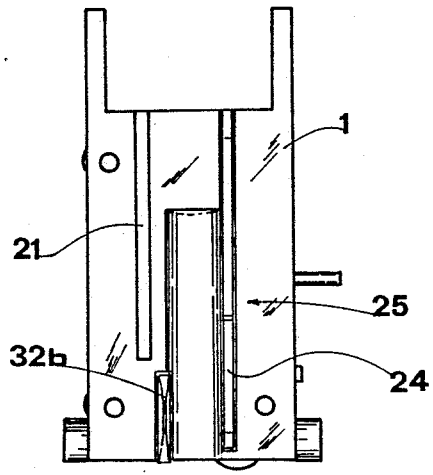
FIG. 6 is a bottom view of the breechblock in a pistol according to the invention.
Figure 5:
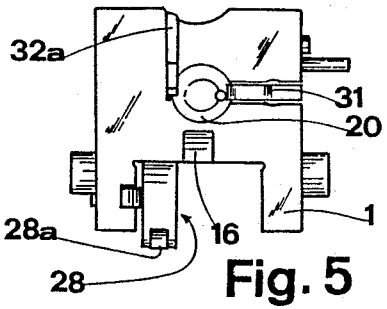
FIG. 5 is a front elevation of the breechblock in a pistol according to the invention.

It will be sufficiently clear to a person skilled in the art that the set of four levers 25, the third lever 17, and the ejector and fourth levers 32 and 34, constitute subassemblies that operate within respective parallel planes and are therefore subject to no mutual contact, as FIG. 6 plainly illustrates.

What is claimed:

1. An improved semi-automatic piston, comprising:

a piston body;

a barrel having an axial bore therethrough connected to an upper forward portion of the piston body;

a tubular magazine for retaining a number of cartridges in coaxial, nose-to-tail fashion, the tubular magazine being connected to the pistol body so as to be parallel and immediately beneath the barrel, the tubular magazine having a magazine spring therein for resiliently urging cartridges out of the magazine, tail end first, through an open rearward end thereof, a rear portion of the magazine extending to the open end being slotted to form at least one radially resilient tongue for retaining cartridges in the magazine against the urging of the magazine spring;

a trigger on the piston body for causing firing of a cartridge loaded in the barrel;

a breechblock slidably connected to an upper portion of the pistol body rearward of the barrel and resiliently urged forwardly toward the barrel by a recoil spring, the breechblock being slidable between a closed position occluding the barrel bore for firing the loaded cartridge, and an open position spaced rearwardly away from the barrel, the breechblock including:

firing means responsive to the trigger for striking the loaded cartridge and thereby firing the pistol; and ejecting means responsive to sliding movement of the breechblock from the closed position to the open position for ejecting from the pistol a shell remaining in the barrel bore after the loaded cartridge has been fired;

the pistol further comprising loading means responsive to sequential rearward then forward sliding movement of the breechblock, for extracting a cartridge from the tubular magazine and transferring the cartridge to the barrel bore for firing, the loading means comprising:

a cradle for elevating a cartridge to be loaded from the tubular magazine to the barrel bore, the cradle being pivotably mounted at its rearward end to the pistol body below the breechblock and pivotable between a first cartridge-receiving position coaxial with the magazine and a second cartridge-loading position wherein the forward end of the cradle is in close proximity to the barrel bore rear end;

a first lever pivotably mounted to the pistol body at a point below the cradle and biased toward the cradle by a first tension means attached to both the first lever and the pistol body, the first lever in turn urging the cradle toward the second cartridge-loading position;

a second lever pivotably mounted to the first lever, having at one end a catch positioned to coincide with a rearward end of a bottom slot in the tubular magazine, the catch end of the second lever being biased upwardly by a second tension means attached to both the first and second levers, the second lever further having at the other end thereof a shank positioned to contact an internal surface of the pistol body so as to cause the catch end to clear the magazine bottom slot when the cradle is in the first cartridge-receiving position;

a third lever pivotably mounted to the pistol body at a point below the breechblock, having a relief thereon for engaging a rear end of the cradle so as to retain the cradle in the first cartridge-receiving position when the breechblock is in the closed position, and so as to release the cradle when the breechblock slides rearwardly to the open position, the third lever being biased by a third tension means toward engagement with the cradle rear end; and a movable cartridge guide pivotably mounted to the pistol body at a point above the breechblock, the movable cartridge guide being pivotable between a raised position when the breechblock is in the closed position and a lowered position in which an end of the cartridge guide is adjacent the rear end of the barrel bore, above and parallel to the bore axis, the movable cartridge guide being biased by a fourth tension means toward the lowered position whenever the breechblock is in the open position.

2. The piston of claim 1 wherein the firing means comprises:

a slidably mounted and substantially cylindrical striker having a firing pin projecting forwardly therefrom, disposed in an internal chamber of the breechblock aligned axially with the barrel bore, the striker being slidable between a cocked position in which the firing pin lies within the internal chamber and an firing position in which the firing pin extends forwardly through an opening in the breechblock so as to contact the rear end of a loaded cartridge, the striker being biased by fifth tension means rearwardly in the internal chamber toward the cocked position;

a detent lever pivotably mounted on the breechblock, the detent lever having a striker catch at one end thereof for retaining the striker in the cocked position, the striker catch being biased by sixth tension means toward the striker;

and wherein the pistol further comprises catch release means responsive to the trigger for pivoting the detent lever so as to release the striker from the cocked position toward the firing position.

3. The pistol of claim 2 wherein the catch release means includes a solenoid having a moving core, whereby movement of the moving core causes pivoting of the detent lever.

4. The pistol of claim 2, further comprising:

cocking means for moving the striker from the firing position to the cocked position in response to sliding the breechblock from the closed position to the open position, the cocking means comprising:

a projection extending radially from a rear portion of the striker; and a contoured lever pivotably mounted to the breechblock, the contoured lever having an upper end disposed to slide in a groove in the pistol body above the breechblock and a lower end, the contoured lever being pivotable between a cocking position in which the contoured lever upper and contacts the groove and rotates the lower end rearwardly against the striker projection, and a ready position in which the contoured lever upper end clears the groove allowing the lower end to rotate away from the striker projection by at least the distance from the striker cocked position to the striker firing position.

5. The pistol of claim 2 wherein the ejecting means comprises:

an ejector lever pivotably mounted on the breechblock and pivotable between an at-rest position and an eject position, the ejector lever being biased by an ejector tension means into the at-rest position in which an ejector lever first arm is flush with a base surface of a socket in the breechblock for retaining a cartridge therein during ejection, and an ejector lever second arm projects downwardly from the breechblock; and an ejector actuating lever having a top end, pivotably mounted to the pistol body, the ejector actuating lever being pivotable between a stop position in which the top end engages the ejector lever second arm during rearward sliding of the breechblock from the closed position to the open position so as to cause pivoting of the ejector lever from the at-rest position to the eject position in which the ejector lever first arm protrudes forwardly from the breechblock socket, and a return position in which the top end is rotates out of engagement with the ejector lever second arm during forward sliding of the breechblock from the open position to the closed position, the ejector actuating lever being biased toward the stop position by seventh tension means connected to the ejector actuating lever.

* * * * *